US005462244A

United States Patent [19]

Van Der Hoek et al.

[11] Patent Number: 5,462,244

[45] Date of Patent: Oct. 31, 1995

[54] SYSTEM FOR DETECTING TRAINS

[75] Inventors: Marinus J. Van Der Hoek, Vlaardingen; Adolf H. K. Moor, Alkmaar; Anastasius J. A. Bruinsma, Delft; Jaap Roos, Pijnacker; Jacobus C. Buisman, Alkmaar, all of Netherlands

[73] Assignee: N.V. Nederlandse Spoorwegen, Utrecht, Netherlands

[21] Appl. No.: 124,040

[22] Filed: Sep. 21, 1993

[30] Foreign Application Priority Data

Sep. 25, 1992 [NL] Netherlands ..... 9201667

[51] Int. Cl.[6] ..... B61L 23/04

[52] U.S. Cl. ..... 246/122 R; 246/246; 73/800; 385/13

[58] Field of Search ..... 246/122 R, 246, 246/247, 249, 251, DIG. 1; 356/73.1, 373; 73/800; 385/12, 13; 250/227.14, 227.15, 227.16

[56] References Cited

U.S. PATENT DOCUMENTS

| | | | |
|---|---|---|---|
| 4,701,614 | 10/1987 | Jaeger et al. | 385/13 X |
| 5,026,141 | 6/1991 | Griffiths | 250/227.15 X |
| 5,191,206 | 3/1993 | Boiarski et al. | 385/12 X |
| 5,240,643 | 8/1993 | Buckley et al. | 385/12 |
| 5,260,566 | 11/1993 | Reed | 385/12 X |
| 5,330,136 | 7/1995 | Colbaugh | 246/246 X |

FOREIGN PATENT DOCUMENTS

| | | |
|---|---|---|
| 3815152 | 11/1989 | Germany . |
| 3844663 | 6/1990 | Germany . |
| 3940006 | 8/1990 | Germany . |
| 3906080 | 8/1990 | Germany . |
| 7901615 | 2/1979 | Netherlands . |
| 2015844 | 9/1979 | United Kingdom . |

*Primary Examiner*—Robert J. Oberleitner
*Assistant Examiner*—S. Joseph Morano
*Attorney, Agent, or Firm*—Watson, Cole, Grindle & Watson

[57] ABSTRACT

A system for detecting one or more vehicles, such as a train, on a rail track, includes at least one optical conductor extending near and parallel to the rail track with a light source and light detector coupled thereto. One or more sensors are coupled to the rail track and include the light conductor, which sensors affect the light attenuation in the light conductor locally upon the presence of the vehicle. The sensor includes a free elongated element, which is connected to the mass of the sensor housing via an elastic hinge connection. One end of the element lies against the light conductor running through the sensor housing, which one end subjects the conductor to a microbending in dependence on displacement of the rail. The elongated element is a pin which runs through a drilled block which is integral with the elastic hinge connection, and at its other end is provided with an outstanding pick-up arm of which the end rests on a contact surface of the fixed substructure of the rail such that the sensor is adapted to detect a displacement or sag of the rail. The arm end may also be free or the pick-up arm may be eliminated such that the sensor is adapted to detect vibrations of the rail. For the purpose of measuring modal noise, the system may comprise an additional optical conductor disposed in close contact with the rail. The conductor may be suspended in a tube provided with perforated partitions, the optical conductor having vibratory masses attached to it.

19 Claims, 6 Drawing Sheets

SYSTEM FOR DETECTING TRAINS

BACKGROUND OF THE INVENTION

1. Field of the Invention

The invention relates to a system for detecting one or more vehicles, such as a train, on a rail track, including at least one optical conductor extending near and parallel to the rail track with a light source and light detector coupled thereto, and one or more sensors coupled to the rail track and including the light conductor, which sensors affect the light attenuation in the light conductor locally upon the presence of the vehicle.

2. The Prior Art

A detection of the presence of a train on a particular railway section has in the past been effected by employing electromagnetic detection means. Thus, for example, the short circuit between rail, which is caused by the wheels and the axles of train sets, was detected and employed, for example, for the automatic operation of a railway crossing. A drawback of such electrical-engineering means, however, is that such short circuits may also arise from other causes, for example, if it rains or if salt is applied. Moreover, the electromagnetic relays employed can be adversely affected by the electric and magnetic fields which are generated within the trains themselves.

Optical train detection means have the advantage that their operation is not affected, or is barely affected, by weather conditions or electromagnetic interference fields. For this reason, optical detection systems have been proposed previously, in which an optical conductor is disposed along a rail, and suitable sensors affect the transmission of light depending on the presence of a train. Thus, for example, optical bending detectors are known which detect the sag of a rail between two sleepers when a train is passing. The sensitivity of such bending detectors is generally not satisfactory, however.

Another proposal was to arrange pressure detectors between the rail and the sleeper or in the rail bed, such as is indicated in DE 3815152 A1. In a pressure detector of this type, the optical conductor, under the influence of a train wheel, is compressed to a certain extent, which results, for example, in part of the transmitted light being coupled from the optical conductor into another optical conductor. The light coupled into the other optical conductor is used to detect the presence of pressure and thus of a train. A pressure detector of this type has the drawback, however, that the optical conductor itself is repeatedly deformed quite strongly, which may lead, in particular, to damage of the coating of the optical conductor. The service life of the optical conductor, such as a glass fibre, is therefore relatively short in known pressure detectors of this type. Moreover, a supplementary optical conductor is required to transmit the extracted light to detection equipment.

SUMMARY OF THE INVENTION

The object of the invention is therefore to provide a system for detecting trains in which system the optical conductor is not exposed to serious deformations affecting the service life and in which it is possible, in principle, to detect the presence of a train using a single optical conductor. This object is achieved, according to the invention, in the system in such a way that the sensor includes a free elongated element which is connected to the mass of the sensor housing via an elastic hinge connection, and that one end of the element lies against the light conductor running through the sensor housing, which one end subjects the conductor to a microbending in dependence on displacement of the rail.

In the system according to the invention, the sensors themselves are therefore not exposed to the pressure of a passing train, but measure the very small displacement of the rail with respect to its substructure as a result of the pressure. The optical conductor then experiences only a very small load upon excitation.

This considerably increases the service life of the sensor and, in particular, of the optical conductor. As a result of the sensors being designed for exerting a local effect on the attenuation of the optical conductor, detection of presence and position can be performed in a simple manner without the need to provide a supplementary optical conductor for ducting off the extracted light. In the system according to-the invention there is no need for breaks in the optical conductors in the sensors, so that there is a relatively small attenuation per sensor, which makes it possible to use a relatively large number of sensors per optical conductor. In this way, moreover, condensation problems on break surfaces are prevented, while the arrangement of optical conductor couplers or the alignment of conductors at the site of the sensors can be dispensed with, which considerably simplifies assembly work.

It should be noted that the term "substructure of the rail" in particular refers to the sleeper or to the clamping backplate or mounting plate arranged on a sleeper. In order to be able to measure a displacement of the rail with respect to its substructure, the rail has to be supported in a manner which is resilient to a certain extent, for example by arranging below the rail a bedplate made of, for example, plastic, rubber, cork or wood. As the displacement to be detected is generally small, for example in the order of magnitude of some tens to a few hundred microns, only a very small degree of resilience is required.

A first embodiment of the system according to the invention is constructed in such a way that the sensors are designed for making the attenuation increase locally as a reaction to the presence of a train, i.e., the attenuation of the optical conductor of which there is at least one. In this embodiment there is provided, in the absence of a train, a minimum attenuation and thus maximum transmission of light.

According to a second embodiment, the system according to the invention is constructed in such a way that the sensors are designed for making the attenuation decrease locally as a reaction to the presence of a train. This ensures that the amount of transmitted light increases when a train is present. This embodiment has the advantage that any unintentional decrease in the transmission of light, caused by external circumstances, cannot be confused with the presence of a train.

Preferably, the system according to the invention is constructed in such a way that the sensors are fastened essentially against the side of the rails. This makes it possible to achieve a good, close contact between sensors and rails, which makes it possible to detect the small relative displacement of the rails. In this arrangement, the body of the sensor preferably rests in the fillet of the rail near the base, which results in the position of the body being well-defined with respect to the rail. Fitting the detectors against the sides of the rails has the further advantage that the sensors may remain fixed in the course of many forms of railway maintenance.

Preferably, the system according to the invention is constructed in such a way that the sensors are provided with a pick-up arm, one end of which permanently rests on a contact surface linked to the substructure of the rail. The contact surface may be formed by the top side of the sleeper, but is preferably formed by a support plate arranged on the sleeper. In this case the sensor is attached in close contact with the rail. This enables accurate tracing and determination of the relative movement of the rail with respect to the substructure of the rail.

In another embodiment of the system according to the invention, the sensor is provided with a pick-up arm, one end of which is free or in the sensor the pick-up arm per se is eliminated. In both cases, the sensor, rather than registering the relative displacement of the rail with respect to its substructure, registers the vibrations in the rail generated by the moving train, so that the presence of a moving train can be detected, and also a rough position detection is possible. Combining sensors of this type with sensors which register the relative displacement of the rail permits supplementary and thus more reliable train detection.

In principle it is sufficient, in the system according to the invention, to use a single optical conductor which is coupled to a number of sensors. It may however be advantageous to construct the system in such a way that a plurality of separate optical conductors connected to alternating sensors is employed. Employing two or more optical conductors has the advantage that the attenuation caused by the sensors in a particular section is spread over the optical conductors, so that within the limits of the maximum permitted attenuation a larger number of sensors can be incorporated in a section. Thus it is possible, using a relatively low instrument resolution, to obtain a high positional resolution in the section. Moreover, a form of redundancy is procured which increases the reliability of the system. The term "alternating" in this case refers not only to the sensors being coupled turn and turn about to, for example, two optical conductors, but also, for example, to the possibility of coupling these sensors in another sequence, which may or may not be recurring, to the optical conductors.

The system according to the invention may be constructed in such a way that it is designed for determining the attenuation in the optical conductor, of which there is at least one, on the basis of the light transmitted by the optical conductor. That means that the light source on one the of the optical conductor emits light into said conductor and that the optical detector at the other end detects the transmitted light, or that one end of the optical conductor is provided with a reflector, the light source and the optical detector being disposed at the same end of the optical conductor. The light employed in the case of transmission detection of this type can be either continuous or pulsed. Employing a transmission detection of this type, it is possible to detect the presence of a train in the section along which the optical conductor extends. A further determination of the position within this section is not possible using transmission detection.

A further embodiment of the system according to the invention is constructed in such a way that for the purpose of measuring modal noise, an optical conductor is disposed in close contact with the pail without the above mentioned sensor. Modal noise can be used advantageously for detecting trains. The presence of a moving train considerably enhances, as a result of vibration of the rails, the noise signal in the light transmission of an optical conductor of this type, disposed in close contact with the rails. If, rather than accurate detection of the position, only the detection of the presence in a certain section is required, it is possible to dispose only a single optical conductor, namely that for measuring modal noise, along the rails. Preferably, however, an optical conductor for measuring modal noise is combined with one or mope optical conductors coupled to sensors, the optical conductors advantageously being arranged in a common sheath. In this arrangement it is possible, with the aid of the modal noise, to detect the presence of a train in a particular section and, at the same time or possibly as a reaction thereto, to establish, based on the sensors, the precise location within that section. Alternatively, an optical conductor of a section can be subdivided into subsections, with the aid of reflectors, which enables position detection roughly.

In the above, the term "sensor" in the first instance refers to a point sensor which can be used for position detection. A point sensor affects the attenuation at a particular point. An optical conductor disposed along one or more rails, for presence detection by means of modal-noise or transmission measurements, however, likewise forms a sensor, described as section sensor hereinafter.

It is possible to combine a section sensor and one or more point sensors, for example by splitting an optical conductor designed for modal noise detection into parts with the aid of weakly reflecting reflectors, which provides the possibility, with the aid of backscatter detection, of rough position indication. Alternatively, an optical conductor can be arranged in a tube fixed closely against the rails, in which the optical conductor is suspended by means of perforated partitions. Weights attached between the partitions on the optical conductor are employed to enhance the detection of modal noise, while a correct choice of the weights provides the possibility of affecting locally, as a reaction to the presence of a train, the attenuation of the optical conductor, as a result of which the weights at the same time form point sensors, and a form of position detection becomes possible.

A preferred embodiment of the system according to the invention is therefore constructed in such a way that it is designed for determining mining the local attenuation in the optical conductor, of which there is at least one, by emitting light pulses and detecting backscattered light pulses. By measuring backscattered light ("Rayleigh backscatter"), a detection signal is obtained which represents the attenuation profile within the optical conductor. The time elapsed between emitting a light pulse and detecting the backscattered light pulse is proportional to the distance of the backscattering point to the light source and light detector. In this way it is possible to obtain, based on a time measurement in the detected signal, an accurate indication of the position where, fop example, an activated sensor causes changing attenuation. By a suitable choice of the duration and the intervals of the light pulses it is possible to select the total amount of light energy required in such a way that a beneficial signal/noise ratio and good detection reliability is achieved. Preferably, the system according to the invention is further provided with means for representing the attenuation as a function of the distance along the optical conductor, of which there is at least one. Based on a representation thus obtained, which is preferably obtained using suitable electronic means and can advantageously be displayed with the aid of a display unit, it is possible to establish in a simple manner, which sensors, as a consequence of the presence of a train, have increased (of reduced) attenuation. Moreover, based on the attenuation characteristics of the section as a whole, quality control of the system is possible. Any change in said visually displayed attenuation characteristics as a result of external circumstances (fop example damage by sabotage of aging) can be detected in a simple manner. If required, a separate display can be provided electronically, fop example with the aid of a sample and hold circuit, of the attenuation fop each sensor.

The system according to the invention can be advantageously constructed in such a way that the plurality of optical conductors at one end together is linked to a further optical conductor which at its other end is coupled to a detector. In this arrangement, the presence detection is essentially determined by means of a transmission measurement, to which end the optical conductors are connected to the detector via the further optical conductor. The position detection takes place by means of the sensors and the detection, performed in a second detector, of backscattered light pulses. The position and presence detection can, in principle, make use of the same light source, although it is also possible to use two separate light sources. In this latter case, position detection and presence detection are preferably achieved employing light having different wavelengths.

Preferably, a plurality of sensors are coupled to a single optical conductor. In order to recognize trains in a simple manner, it may be advantageous to connect a sensor to a separate, individual optical conductor, or the attenuation profile of a section can be used to isolate the attenuation contributions of a single sensor, for example by employing a sample and hold circuit. Based on the varying attenuation, of an individual sensor, which is caused by the varying imprint of a passing train, it is possible to determine a signature or "finger-print" of a separate train. Based on this signature (attenuation signature) it is possible to identify and follow an individual train in a railway network. This for instance is advantageous when a plurality of trains each with its own signature, is running simultaneously on a section and after passage of one or more switch points it should be checked whether each train has followed its correct track.

By employing the above system according to the invention the presence of a plurality of trains, moving independently of each other, can be established, whereby through localization a free space before and after each train can be defined within which no other trains should be. Through this the possibility arises to realize so called sliding blocks by which the transportation capacity and safety of the railway infrastructure is considerably enlarged.

In principle it is also possible, by applying the system, to determine the total mass of a passing train (tonnage passed). If necessary, sensors can be disposed both on the left-hand side and the right-hand side of the track. In this way it is in principle also possible to measure varying forces, for example due to irregularities in the wheels (quality of rolling stock). If a conventional system, provided with discrete axle counters, is used, such a measurement is not possible. Using the system according to the present invention does, of course, make it possible to count the number of axles on the basis of the analog signature determined.

A sensor for use in a system according to the invention is preferably provided with a pick-up arm which is coupled to a pin, the pin being designed for bending, as a function of displacement of the pick-up arm, an optical conductor which is run through the sensor. A sensor of this type is advantageously provided with attachment means for attaching to the rails.

It will be evident that the invention is not limited to trains, but can equally be applied, for example, in tram and metro networks or in rail connections in the case, for example, of mines and factories.

The invention will be explained below in more detail with reference to the drawings.

DETAILED DESCRIPTION OF THE PREFERRED EMBODIMENTS

Figure 1:
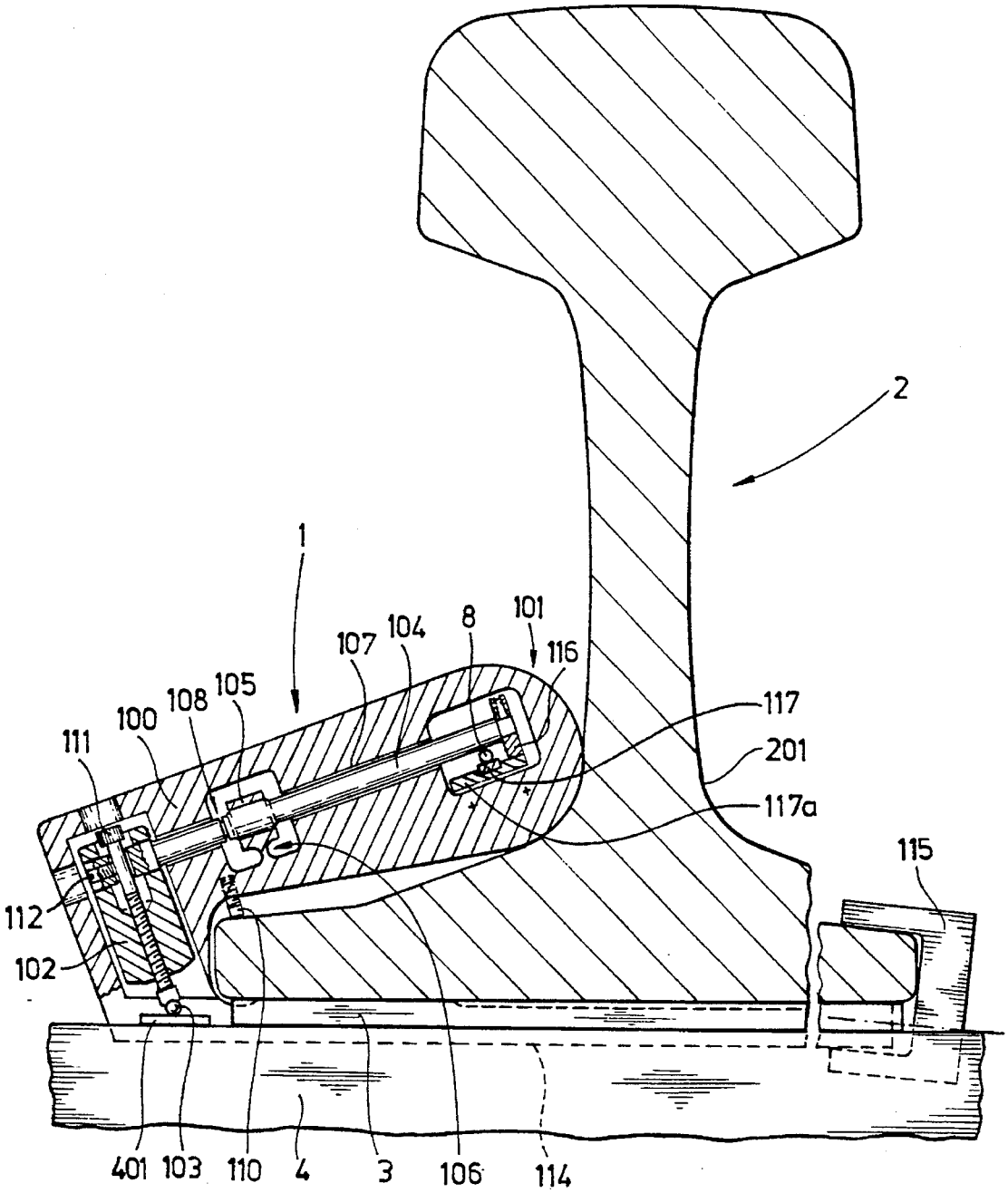
FIG. 1 shows a cross-sectional view of a sensor according to the invention, disposed against a rail.

FIG. 1 shows, in cross section, a rail 2 which, with the interposition of a bedplate 3, is arranged on a sleeper 4 and with the aid of fastening means (not shown) is fastened to the sleeper 4. A sensor 1, likewise shown in cross section, is disposed against the rail 2. The sensor 1 has a rounded top 101 which is shaped in such a way that it closely fits the fillet 201 of the rail 2, so that a good contact is obtained between the rail 2 and the sensor 1.

The sensor 1 comprises a pick-up arm or measuring pin 102, of which one end is provided with a sphere 103. The sphere 103 rests on a support plate 401 which is attached to the top face of the sleeper 4. The support plate 401 can optionally be omitted, so that the sphere 103 rests directly on the top side of the sleeper 4. For the purpose of setting the distance between the measuring pin 102 and the sphere 103, the central section of the measuring pin 102 is constructed as an adjusting screw 111. A securing screw 112 is provided for fixing the screw 111 in the position set.

The measuring pin 102 is rigidly attached to a pin 104. Said pin 104 is incorporated in a part 105 which, by means of a narrow elastic link 106, is linked to the body 100 of the sensor 1 in a hinged manner. The pin 104 is positioned, with a close fit, in a bore 107 which is arranged in the body 100 of the sensor 1. The pin 104 together with the elastic hinge 106 forms an elastic or resilient construction, the pretension of which can be adjusted by screw 111. Thereby a permanent mechanical contact between sphere 103 and support plate 401 is guaranteed through which acceleration forces experienced during wheel passage are smaller than in case the sphere 103 is free from the support plate. The pin 104 is further provided with a narrowing 108, which also forms an elastic hinge in order to absorb excessive displacements of the measuring pin 102.

Arranged below the sensor 1 there is a guard pin 110 which serves to absorb external forces exerted on the sensor 1. This prevents erroneous detection, for example if somebody steps on the sensor. The guard pin 110 is disposed in the body 100 of the sensor I with the aid of screw threads. The body 100 is furthermore rigidly attached to the rail 2 with the aid of an arm 114 and a clip 115.

If a wheel of a train moves over the rail 2 in the vicinity of the sensor 1, the rail will exert pressure on the bedplate 3 and will compress this to a certain extent. This causes a relative movement of the rail 2 and also of the body 100 of the sensor with respect to the sleeper 4 and thus also with respect to the support plate 401. Thereby via the sphere 103, which permanently lies upon support plate 401, and the measuring pin 102 an upward pressure is exerted on the left end of pin 104, which then experiences a microdisplacement. This displacement is transmitted, via the pin 104 which is hinged with respect to the body 100 with the aid of the hinge elements 105 and 106, at the other side to the optical conductor 8 which is run through the head 101 of the sensor 1. As shown in FIG. 2 in more detail, this causes bending of the optical conductor 8, as a result of which the attenuation of the optical conductor 8 is affected locally.

Figure 2A:
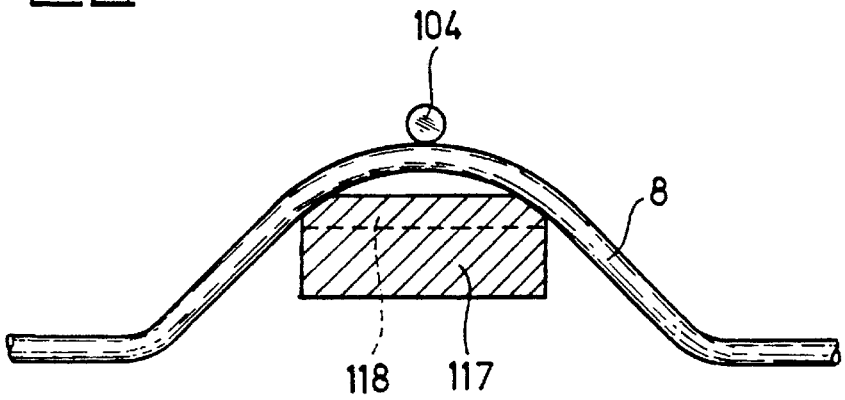
FIGS. 2*a*, 2*b* and 2*c* diagrammatically show, in profile, respectively a part of the interior of the sensor of FIG. 1.
Figure 2B:
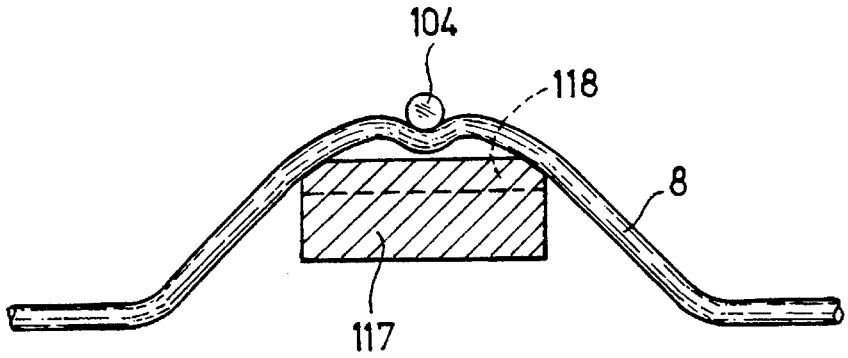
Figure 2C:
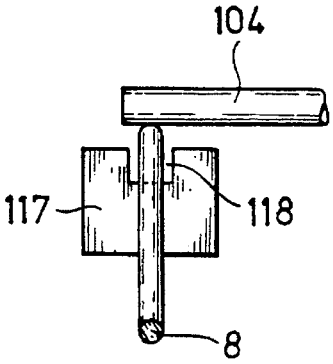

In FIG. 2, the principle of the sensor 1 is depicted in more detail. FIG. 2*a* shows the optical conductor 8 which runs through the sensor 1 and is preferably formed by a glass fibre, but may also comprise another type of optical conductor, for example a plastic fibre. The optical conductor is preferably provided with a suitable coating. The glass fibre 8 is supported by a support 117 in such a way that the glass fibre shows a slight curvature. When mounting the fibre 8, the support plate 117*a*, supporting the carrier 117 and hingeable at one side, and the adjusting screw 111 together cooperate in adjusting the mutual position of the end of the pin 104 and the fibre 8 such that this pin end 104 contacts the glass fibre 8 at the top of said curvature. As a result of the movement of the rail 2 with respect to the sleeper 4, which movement is transmitted by the measuring pin 102 and the pin 104, the end of the pin 104 is pressed against the glass fibre 8. This causes an additional bend in the glass fibre, as depicted in FIG. 2*b*. Because a plurality of bends now arises in the glass fibre 8, losses arise which manifest themselves as increased local attenuation. By employing this so-called "micro-bending" it is possible to obtain a readily detectable local change in attenuation without damaging the glass fibre. The support 117 is provided with a groove (shown in FIGS. 2*a* and 2*b* with broken lines) 118 for receiving the glass fibre in the case of large deflections of the pin 104 as indicated in FIG. 2*c*. While the fibre then unhindered goes down into the groove, the pin will abut against the edges of the groove, formed by the carrier 117, which edges form a stop. This prevents damage to the glass fibre in the case of sensor 1 being heavily stressed. An eccentric wheel 116 which is disposed on the end of the pin 104 likewise serves to limit the movement of the pin 104 with respect to the glass fibre 8. In case of an occurring limitation by the excentric wheel 116 or abutment of pin 104 on carrier 117, the pin 104 will be protected, upon further stress on the sensor 1, against inelastic deformation because of the elastic hinge 108.

It is obviously possible to construct the sensor 1 in such a way that the situation of FIG. 2*b* arises in the unstressed state and that the stressed state gives rise to the situation of FIG. 2*a*, i.e. in the presence of a train the attenuation caused by the sensor 1 is reduced. In both cases, the sensor 1 forms a point sensor or mechanical interaction point ("MIP"), i.e. a sensor which, by means of a local change in attenuation, enables position detection.

Figure 3:
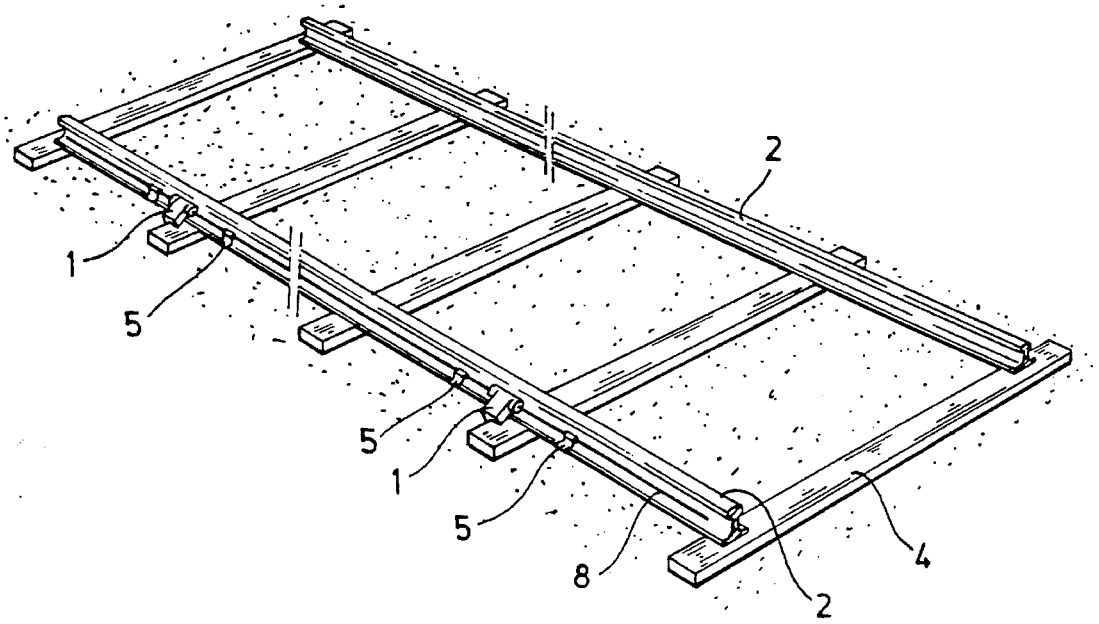
FIG. 3 shows, in perspective, a part of a track section, provided with the system according to the invention.

The part of a track section shown in perspective in FIG. 3 comprises rails 2 and sleepers 4. At the side of one of the rails 2, in this case on the outside (on the inside is also possible) and in the fillet of the rail, an optical conductor 8 is disposed. Said optical conductor 8 may consist, for example, of a single glass fibre or a bundle of glass fibres or plastic fibres, provided with a suitable sheath. Clamps 5 are employed to fasten the optical conductor 8 to the rail 2. Disposed at suitable spacings along the rail 2 are sensors 1 through which the optical conductor 8 is run. The sensors 1 are preferably constructed in such a way that they are located above one of the edges of a sleeper 4. This makes it possible, on the one hand, fop the measuring pin 102 to permanently rest on the sleeper 4 and, on the other hand, fop the sensor 1 to be fastened with the aid of the arm 114 and clip 115 (see FIG. 1) engaging the rail from below.

Figure 4:
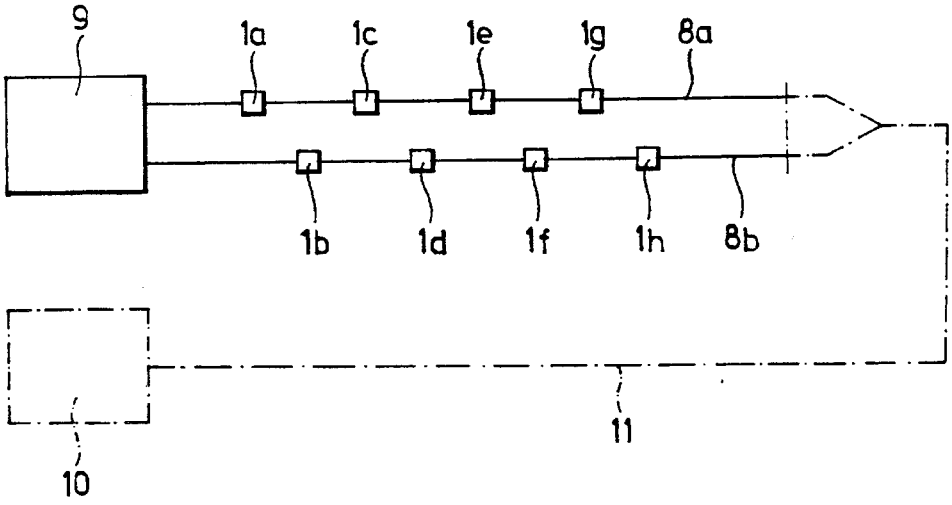
FIG. 4 diagrammatically shows a first embodiment of the system according to the invention.

FIG. 4, in diagrammatic form and by way of example, shows a top view of the system according to the present invention containing two optical conductors 8*a* and 8*b* which are formed by glass fibres. Alternatively, the system according to the invention may however be constructed with a single optical conductors. For the sake of smaller attenuation of each optical conductor and of greater redundancy it is however advantageous to provide the system with two or mope, fop example three, four or ten, parallel optical conductor. Disposed against a rail (not shown) at defined spacings there are sensors 1. In this arrangement, the sensors 1*a*, 1*c*, 1*e* and 1*g* are connected to the optical conductor 8*a*, while the sensors 1*b*, 1*d*, 1*f* and 1*h* are connected to the optical conductor 8*b*.

The optical conductors 8 are connected to a device 9 which comprises a coherent light source (fop example a laser) and an optical detector. This device 9 is used to generate light pulses and couple them into the respective optical conductors. The light pulses which pass through the optical conductor 8 also pass through the sensors 1*a*, 1*c*, 1*e* and 1*g*. Attenuation will occur in these sensors, its magnitude depending on the presence of a train. With the aid of "optical time domain reflectometry" ("OTDR") it is possible to determine this attenuation as a function of the time and thus as a function of the position. This involves making use of the scatter ("Rayleigh backscatter") which occurs in optical fibres. As a result of a light pulse being emitted from the device 9, a backscattered signal will arise whose magnitude depends on the attenuation in the fibre. This is shown in FIG. 5 by way of a graph in which, along the horizontal axis, the time t is plotted as a measure for the distance s in the conductor, and along the vertical axis the light intensity I is plotted as a measure of the backscattered light on the basis of which the attenuation can be determined. The light source and the detector, respectively, may be a commercially available laser and a commercially available detector suitable fop the wavelength employed. The device 9 is further preferably provided with electronic processing and display means.

FIG. 5 shows the signal thus detected as a function of time. From time t=0, backscattered light is received in the device 9. At time t=T light is received which, after a delay time equal to 0.5×T was backscattered and thus in the respective optical conductor has covered a distance which is related to said delay time. In this way it is possible to obtain information on the attenuation profile in the optical conductors.

Figure 5A:
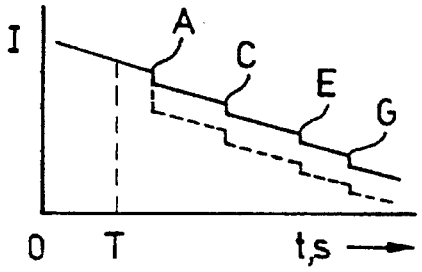
FIG. 5*a–c* shows a graph of the attenuation profile in an optical conductor as a function of position.
Figure 5B:
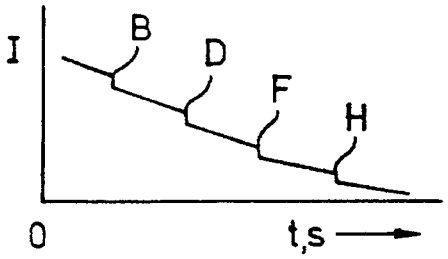

In FIG. 5*a*, the attenuation profile of the optical conductor 8*a* is therefore plotted as a function of the distance s from the device 9. In FIG. 5*a*, the intrinsic attenuation caused by the sensors 1*a*, 1*c*, 1*e* and 1*g*, designated respectively by A, C, E and G, is clearly discernible. The magnitude of each step at A, C, E and G provides an indication of a correct adjustment of the sensor in those positions. If now, for example, sensor la is activated by a train, the attenuation of said sensor increases, as reproduced in FIG. 5*a* by a broken line.

Figure 5C:
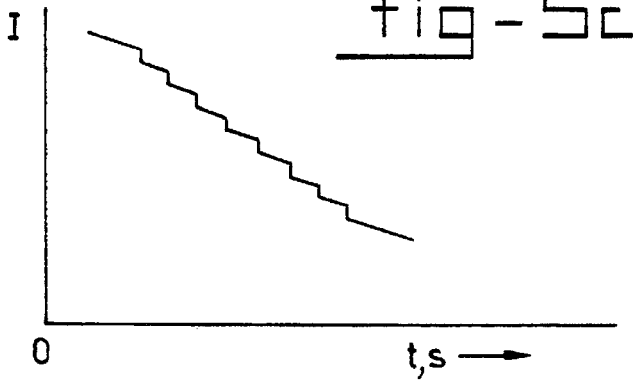

FIG. 5*c* shows the total attenuation profile of the section depicted in FIG. 4. This attenuation profile is composed of the attenuation profile, shown in FIG. 5*a*, of the optical conductor 8*a* and the attenuation profile, shown in FIG. 5*b*, of the optical conductor 8*b*. It will be evident that the intensity of the emitted light pulses has to be chosen in such a way that backscattered pulses are detectable even after passing a large number of sensors. Employing two optical conductors, as depicted in FIG. 4, in this case has the advantage that the attenuation arising for each optical conductor is small, which makes it possible to employ pulses having a lower light intensity.

The graphical representation of the total attenuation profile of the section, as depicted in FIG. 5*c*, provides the option of checking the quality of the system. If a break occurs in one of the optical conductors, for example caused by sabotage, this shows up directly in the graph of FIG. 5*c* as a very strongly increased attenuation at the position of the damage.

FIG. 4 depicts, as broken lines, a further embodiment which has been supplemented with a further optical detector 10 and a further optical conductor 11. One end of said further optical conductor 11 is linked to both the optical conductor 8*a* and the optical conductor 8*b*, while the other end is connected to the further optical detector 10. This setup makes it possible to measure, in addition to (or possibly as a replacement of) the measurement of backscattered light pulses as described in the above, light pulses transmitted by the optical conductors 8. For the purpose of a transmission measurement of this type it is also possible to use a non-coherent light source which may or may not be pulsed.

Figure 6A:
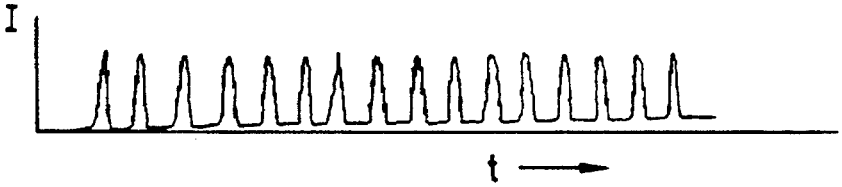
FIG. 6*a–b* shows graphs of the detection signal during transmission measurements.
Figure 6B:
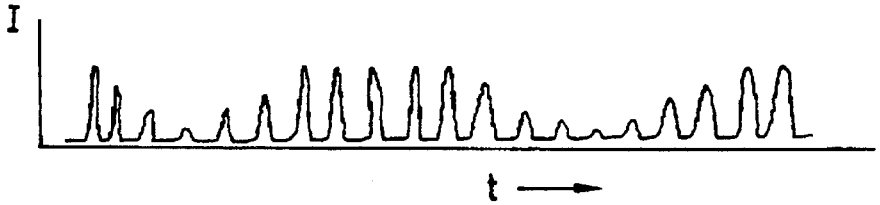

FIG. 6 shows a graph of the output signal of the optical detector 10. If the device 9 emits optical pulses having a sufficient intensity, these will be detected by the optical detector 10. In the absence of a train, they are all of approximately the same magnitude, owing to the constant attenuation in the section, as is depicted in FIG. 6*a*. The presence of a moving train in the section will however activate the sensors 1, which causes variation in the attenuation in the section. As a result, the pulses received by the optical detector 10 will be of different magnitudes, as depicted in FIG. 6*b*. Such a so-called transmission detection can therefore be used to establish the presence of a moving train in the section. If more accurate information regarding the position of the train is required, it is possible to activate, in reaction to said transmission detection, the position detection described with reference to FIGS. 4 and 5.

In the above various embodiments the sensor of FIG. 1 drawn as a point sensor has been used both for position detection and for presence detection. Said sensor in fact could be termed a displacement point sensor capable of reacting upon dynamic and static impressions of a train wheel on the rail, i.e. a moving or standing train.

As already explained in the introduction, the sensor of FIG. 1 in a variant may have a measuring pin of which the end is free, i.e. is totally free from the support plate 401. In this case, the sensor, rather than registering the relative displacement of the rail, registers the vibrations in the rail generated by the moving train. The sensor could be termed as a vibration point sensor which reacts to the dynamic impressions (and not to static impressions). The vibration sensor can serve as a presence sensor comparable with the action of the modus fibre, displayed in FIG. 6*b*, and also as a position detector providing a rough indication of the position. The vibration sensor can also be implemented with its pick-up arm eliminated. In the latter case the sensor has a more simplified form and the relative end is closed off by a cover plate. In both above cases the pick-up arm or the pin 104 may have an additional mass at said end in order to adjust the vibrational characteristics of the sensor.

Figures 7, 8:
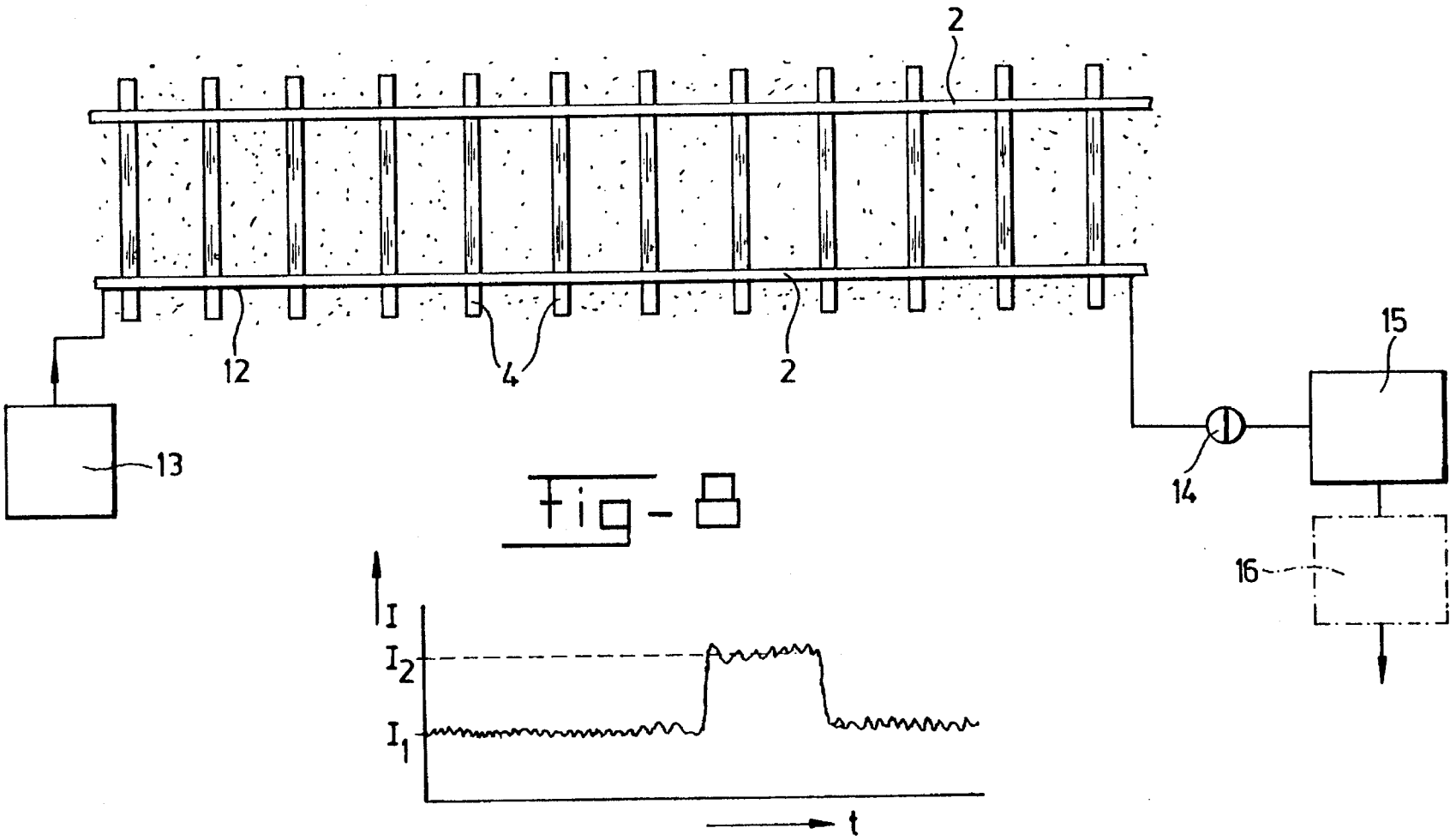
FIG. 7 diagrammatically shows a system according to the invention, designed for detecting modal noise.
FIG. 8 shows a graph of the output signal of the system of FIG. 7.

FIG. 7 represents the case in which there is disposed, along a rail 2, an optical conductor 12 for detecting optical modal noise. The optical conductor 12 comprises an optical conductor, such as a glass fibre cable or a plastic fibre cable, which is attached in close contact to the rail. A coherent light source 13 injects light at one end into the guide 12. At the other end of the guide 12, the light is passed, via a mode filter 14, to an optical detector 15. The output signal of the optical detector 15 is preferably passed through a band filter 16 in order to eliminate unwanted frequency components. The output signal of the band filter 16 is depicted in FIG. 8 as a function of time. If no train or a stationary train is present on the section of the conductor 12, the noise signal has a first level $I_1$. If a moving train manifests itself on the section, the noise level increases up to $I_2$, as can be seen from FIG. 8. Experiments have shown that the noise level thus detected is approximately proportional to the speed of the train. This form of detection can therefore be used not only to detect the presence of a moving train within a section, but also to provide an estimate of the speed of the train. This form of detection, in which the whole length of the optical conductor attached to the rails functions as a sensor, i.e. as a rough section sensor, can therefore advantageously be combined with the position detection according to FIG. 4, but optionally also be employed separately, i.e. in a detection system without point sensors. As already mentioned in the introduction, said optical conductor designed for modal noise detection can also be used to provide a rough position indication.

Figure 9:
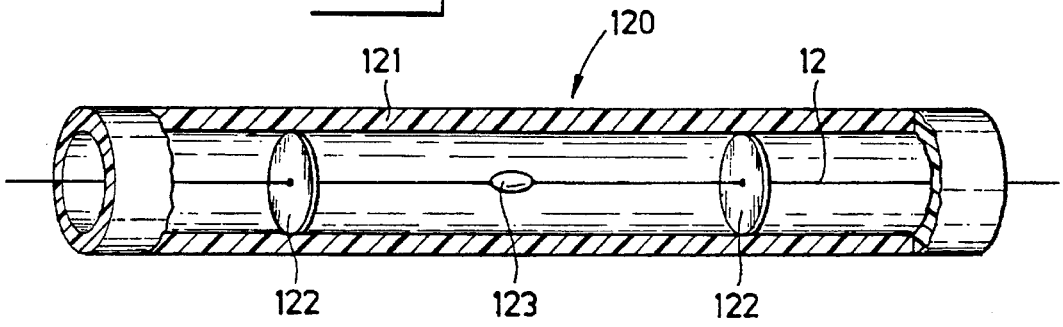
FIG. 9 shows a view of a tube and an optical conductor of the system of FIG. 7.

FIG. 9 shows such an optical conductor for modal noise detection. The conductor 12 is arranged in a tube 120 to be fitted closely against the rails. The conductor 12 is suspended on perforated partitions 122 mounted transversely on the protecting flexible sheath 121, resistent against radial stress, of the tube. It is of advantage to attach small weights 123 between the partitions on the optical conductor in order to enhance the vibration and the detection of modal noise. By selecting the weights correctly, the attenuation of the optical conductor, as a reaction to the presence of a train, is locally affected due to which the weights also form point sensors and a rough position detection is possible.

Figure 10:
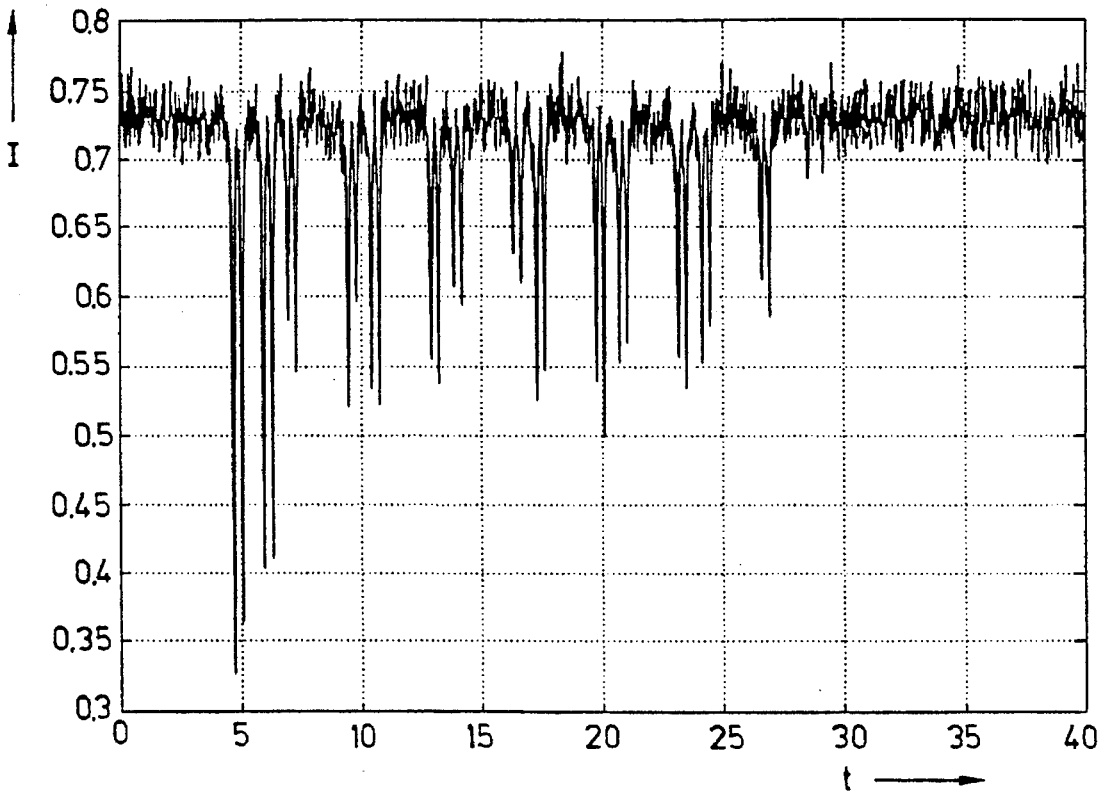
FIG. 10 shows a train signature, obtained with the aid of a single point sensor.

FIG. 10 illustrates the use of a point sensor for determining the signature of a train. The train passing along the sensor causes increased attenuation which manifests itself by a strongly reduced intensity I of the backscattered light. FIG. 10 clearly indicates the passing of a relatively heavy locomotive having four axles, followed by six lighter wagons, each likewise having four axles. The train signature thus determined can be used to identify this train on the same section or on another section, or, for example, to check the uncoupling and coupling on of wagons.

By means of the system according to the invention, the position of both a moving and a stationary train within a section can be determined accurately on the basis of backscattered light. In this system, the optical fibre is not exposed to serious deformations. Employing a position-dependent attenuation measurement provides the additional advantage that damage to the optical conductor(s) can be localized accurately. Employing additional optical conductors makes it possible, in addition, to determine the presence and optionally the speed of a train within the section. The system according to the present invention is therefore very suitable for safeguarding and monitoring a railway network.

We claim:

1. A system for detecting one or more vehicles on a rail track mounted on a fixed substructure, comprising at least one optical conductor extending near and parallel to the rail track with a light source and light detector coupled thereto, and at least one sensor coupled to the rail track and including the optical conductor, which sensor senses the light transmission in the optical conductor locally upon the presence of a vehicle, wherein the sensor is incorporated in a sensor housing and includes a free elongated element, which is connected to the sensor housing via an elastic hinge connection, and wherein one end of the elongated element abuts against the optical conductor running through the sensor housing and the other end is subjected to displacement of the rail relative to the fixed substructure of the rail.

2. System according to claim 1, in which the elongated element at its other end is provided with an outstanding pick-up arm of which the end rests on a contact surface, linked to the fixed substructure of the rail such that the sensor is adapted to detect a displacement or sag of the rail.

3. System according to claim 1, in which the elongated element at its other end is provided with an outstanding pick-up arm, of which the end is free such that the sensor is adapted to detect vibrations of the rail.

4. System according to claim 1, in which the elongated element is adapted to detect vibrations of the rail and is provided at its other end with a mass.

5. System according to claim 1, in which a plurality of separate optical conductors connected to alternating sensors is employed.

6. System according to claim 5, in which the plurality of optical conductors at one end is linked to a further optical conductor coupled to the detector.

7. System according to claim 1, adapted to determine the attenuation in the at least one optical conductor, on the basis of the light transmitted by the optical conductor.

8. System according to claim 1, in which for the purpose of measuring modal noise, the optical conductor is disposed in close contact with the rail.

9. System according to claim 1, in which the optical conductors are arranged in a common sheath.

10. System according to claim 1, adapted to determine the attenuation in the at least one optical conductor, by emitting light pulses and detecting back scattered light pulses.

11. System according to claim 10, provided with means for representing the attenuation as a function of the distance along the at least one optical conductor.

12. System according to claim 1, provided with means for recognizing a train, based on the attenuation of one said sensor.

13. System according to claim 1, wherein said sensor is provided with attachment means for attaching to the rail.

14. A system according to claim 1, wherein the sensor housing at one end has a shape disposable in a close fit against a side of a rail and at the other end has a fastening means to be fixed to the rail.

15. A system according to claim 14, wherein the shape of the one end of the sensor housing is rounded to lie against a fillet near the rail base.

16. A system according to claim 1, wherein the elongated element is a pin which runs through a drilled block which is integral with the elastic hinge connection.

17. A system according to claim 16, wherein the pin is provided with a narrowing near the drilled block functioning as a further elastic hinge to absorb excessive displacements.

18. Sensor apparatus for use in a system for detecting one or more vehicles on a rail track mounted on a fixed substructure, said sensor apparatus comprising a housing through which an optical conductor extends and a free elongated element which extends within the housing and includes an elastic hinge connection to the housing, a first end of said free elongated element abutting the optical conductor and a second end of said free elongated element being subject to displacement of the rail track relative to the fixed substructure to thereby cause said first end to act on the optical conductor and change light transmission therethrough.

19. Sensor apparatus according to claim 18, said sensor apparatus further comprising a tube and a plurality of perforated partitions mounted in said tube and through which extends an additional optical conductor having vibratory masses attached to it.

* * * * *